US006770615B1

(12) United States Patent
Aouad et al.

(10) Patent No.: US 6,770,615 B1
(45) Date of Patent: Aug. 3, 2004

(54) NON-AQUEOUS LIQUID DETERGENTS WITH WATER-SOLUBLE LOW-DENSITY PARTICLES

(75) Inventors: Yousef Georges Aouad, Cincinnati, OH (US); Christopher John Lienhart, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 158 days.

(21) Appl. No.: 10/048,698

(22) PCT Filed: Aug. 8, 2000

(86) PCT No.: PCT/US00/21572

§ 371 (c)(1),
(2), (4) Date: Jan. 31, 2002

(87) PCT Pub. No.: WO01/11003

PCT Pub. Date: Feb. 15, 2001

Related U.S. Application Data

(60) Provisional application No. 60/150,431, filed on Aug. 24, 1999, provisional application No. 60/147,996, filed on Aug. 10, 1999, and provisional application No. 60/148,054, filed on Aug. 10, 1999.

(51) Int. Cl.[7] ..... C11D 17/00
(52) U.S. Cl. ..... 510/418; 510/443
(58) Field of Search ..... 510/418, 443

(56) References Cited

U.S. PATENT DOCUMENTS

| | | | |
|---|---|---|---|
| 3,615,811 A | | 10/1971 | Barrett |
| 4,767,558 A | | 8/1988 | Ouhadi et al. |
| 5,759,981 A | | 6/1998 | Boutique et al. |
| 5,814,592 A | | 9/1998 | Kahn et al. |
| 5,872,092 A | | 2/1999 | Kong-Chan et al. |
| 5,945,392 A | | 8/1999 | Boutique et al. |
| 6,165,959 A | | 12/2000 | Meyer et al. |
| 6,207,634 B1 | | 3/2001 | Meyer et al. |
| 6,239,094 B1 | | 5/2001 | Goderis et al. |
| 6,277,804 B1 | | 8/2001 | Kahn et al. |
| 6,281,187 B1 | | 8/2001 | Smerznak |
| 2003/0109397 A1 | * | 6/2003 | Aouad et al. |

FOREIGN PATENT DOCUMENTS

| | | | | |
|---|---|---|---|---|
| DE | 42 13 036 | | 10/1993 | |
| EP | 0 386 868 | | 9/1990 | |
| WO | WO 97/00937 | | 1/1997 | |
| WO | WO 98/00518 | | 1/1998 | |
| WO | WO 01/11002 | * | 2/2001 | ..... C11D/117/00 |

* cited by examiner

*Primary Examiner*—Yogendra N. Gupta
*Assistant Examiner*—John M Petruncio
(74) *Attorney, Agent, or Firm*—C. Brant Cook; Jerry J. Yetter; Armina E. Matthews

(57) ABSTRACT

Non-aqueous liquid detergent compositions comprising from about 49% to about 99.95% by weight of the composition of a surfactant-containing non-aqueous liquid phase and from about 0.05% to about 51% by weight of the composition of a suspended solid particulate phase wherein the suspended solid particulate phase comprises water-soluble low-density particles which are composed of a binding agent and materials selected from the group consisting of an alkalinity source, a chelant, a builder and mixtures thereof. By the present invention, ingredients which are insoluble in the surfactant-rich liquid phase may be included in the liquid phase without undesirable segregation and separation.

15 Claims, No Drawings

NON-AQUEOUS LIQUID DETERGENTS WITH WATER-SOLUBLE LOW-DENSITY PARTICLES

RELATED APPLICATIONS

This application claims priority to International Application Ser. No. PCT/US00/21572 dated Aug. 8, 2000 which claims benefit of U.S. 60/148,054 dated Aug. 10, 1999 and claims the benefit of U.S. 60/147,996 dated Aug. 10, 1999, and claims benefit of 60/150,431 dated Aug. 24, 1999.

FIELD OF THE INVENTION

This invention relates to liquid laundry detergent products which are non-aqueous in nature and which are in the form of stable dispersions of water-soluble particulate material and preferably also include other materials such as bleaching agents and/or conventional detergent composition adjuvants.

BACKGROUND OF THE INVENTION

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Because liquid laundry detergents are usually considered to be more convenient to use than granular laundry detergents, they have found substantial favor with consumers.

However, while liquid laundry detergents have a number of advantages over granular laundry detergent products, there are also disadvantages entailed in using them. In particular, laundry detergent composition components which may be compatible with each other in granular products may tend to interact or react with each other in a liquid, and especially in an aqueous liquid, environment. Components such as peroxygen bleaches and bleach precursors can be especially difficult to incorporate into liquid laundry detergent products with an acceptable degree of compositional stability. Poor compositional stability may cause some active ingredients to react with each other prematurely in the product which can cause physical instabilities such as phase splitting, sedimentation and solidification. This premature reaction may also cause chemical instabilities which can lead to product discoloration or color change, oxygen gas liberation, oxidation of sensitive ingredients (especially enzymes) and eventually detersive performance loss.

One approach for enhancing the chemical compatibility and stability of liquid laundry detergent products has been to formulate non-aqueous (or anhydrous) liquid laundry detergent compositions. Generally, the chemical stability of the components of a non-aqueous liquid laundry detergent composition increases as the amount of water in the laundry detergent composition decreases. Moreover, by minimizing the amount of water in a liquid laundry detergent composition, one can maximize the surfactant activity of the composition. Non-aqueous liquid laundry detergent compositions have been disclosed in Hepworth et al., U.S. Pat. No. 4,615,820, Issued Oct. 17, 1986; Schultz et al., U.S. Pat. No. 4,929,380, Issued May 29, 1990; Schultz et al., U.S. Pat. No. 5,008,031, Issued Apr. 16, 1991; Elder et al., EP-A-030,096, Published Jun. 10, 1981; Hall et al., WO 92/09678, Published Jun. 11, 1992 and Sanderson et al., EP-A-565,017, Published Oct. 13, 1993.

However, certain common detergent ingredients such as builders and alkalinity sources (i.e. buffers) are not generally soluble in most non-aqueous solvents and because these ingredients are typically denser than the liquid matrix of a non-aqueous detergent composition, they have a tendency to separate out of liquid detergent products and form sediments on the bottom of the detergent container between their manufacture and usage by the consumer. This segregation can in turn have an adverse affect on product aesthetics, usage instructions, pourability, dispensability, stability and in particularly on the overall cleaning effectiveness.

Given the foregoing, there is a continuing need to formulate non-aqueous liquid laundry detergent compositions comprising ingredients (e.g. builders, alkalinity sources) which are insoluble in the non-aqueous detergent liquid without the undesirable separation and segregation phenomena discussed above. Accordingly, it is a benefit of the present invention to provide non-aqueous liquid laundry detergent compositions which have excellent cleaning and detersive performance without displaying deleterious separation and segregation phenomena.

SUMMARY OF THE INVENTION

It has now been discovered in the present invention that non-aqueous liquid laundry detergent compositions may contain ingredients which are insoluble in the liquid matrix of the detergent composition, without the undesirable separation and segregation of said insoluble ingredients by including, in addition to the insoluble ingredients, low-density particles which reduce the tendency of the insoluble ingredient particulates to separate out of the laundry detergent composition and sediment to the bottom of the detergent container. The low-density particles themselves are composed of a binding agent as well as one or more ingredients which are insoluble in the non-aqueous liquid matrix. These low-density particles have the further advantage that while they are insoluble in the non-aqueous liquid phase, they are completely soluble in water.

The non-aqueous liquid detergent compositions according to a first aspect of the present invention comprise from about 49% to about 99.95% by weight of the composition of a surfactant-containing non-aqueous liquid phase; and from about 0.05% to about 51% by weight of the composition of a suspended solid particulate phase. The suspended solid particulate phase, in particular, comprises low-density particles which are composed of a binding agent and materials selected from the group consisting of an alkalinity source, a chelant, a builder and mixtures thereof.

The present invention further encompasses a process for continuously preparing low-density particles comprising the steps of continuously mixing water, water-soluble binder and one or more particle ingredients to form an aqueous solution; and then subsequently drying the solution in a spray-dryer to from low-density particles having a substantially spherical shape and a particle size from about 1 $\mu$m to 120 $\mu$m.

The low-density particles of the present invention may also be used as one of the constituent detergent particles of a granular detergent.

All parts, percentages and ratios used herein are expressed as percent weight unless otherwise specified. All documents cited are, in relevant part, incorporated herein by reference.

DETAILED DESCRIPTION OF THE INVENTION

Definitions—As used herein, "non-aqueous" or "anhydrous" are used synonymously and both describe a fluid in which the water content is less than about 5%.

Suspended Particulate Solids

In addition to the surfactant-containing liquid phase (described below), the non-aqueous detergent compositions herein preferably comprise from about 1% to 50% by weight, more preferably from about 29% to 44% by weight, of suspended solid particulate material which is dispersed and suspended within the liquid phase.

A. Low-Density Particles

An essential component of the liquid detergent compositions of the present invention is the inclusion of low-density particles, the particles are dried in such a way that they are completely or partially hollow. When incorporated into the non-aqueous liquid detergent compositions of the present invention, the low-density particles reduce the tendency of other solid particulate ingredients to separate out of the laundry detergent composition and form a sediment layer on the bottom of the detergent composition container. (The low-density particles are themselves less dense than the surrounding, non-aqueous surfactant-rich liquid matrix; hence they are referred to throughout this application as "low-density particles.")

Without being limited by theory there are at least two proposed explanations for how the suspended particles accomplished these benefits. A first explanation for the benefits provided by the low-density particles is that they provide a counteracting resistance to the sedimentation of the adjuvant particles. As the adjuvant particles flow downward at a rate governed by Stokes' Law they come into physical contact with the low-density particles which impede their further downward movement until the adjuvant particles can migrate around the outer surface of the low-density particles. Thus the low-density particles form an obstacle field which considerably reduces the rate of sedimentation of the adjuvant particles. The detailed path that individual adjuvant particles take through this obstacle field may be calculated using an analysis based on Brownian Motion or Ising Model calculations.

Still another explanation is that a sufficient amount of the low-density particle is added to the liquid phase so that the mean, statistically weighted densities of the adjuvant particles and the low-density (when taken together) is approximately the same as the density of the liquid phase. Essentially, this means that the density of all of the suspended solid particle phase is matched with the density of the liquid phase. Thus as the rate of sedimentation is directly proportional to the difference in densities between the liquid and the suspended solid phase (Stokes' Law), the rate of sedimentation is considerably reduced.

The low-density particles of the present invention are preferably constructed from material which is insoluble in the non-aqueous surfactant-rich liquid phase of the present invention but soluble in pure water. The low-density particles are preferably partially or completely hollow particles formed through the spray-drying processes described below; microspheres are an especially preferred form of the low-density particle. Nonlimiting examples of such hollow microspheres are commercially available as EXPANCEL® microspheres. For further discussion of microspheres, see "Microencapsulation" in Kirk-Othmer Encyclopedia of Chemical Technology, Third Edition, Volume 16, pages 628–651 (John Wiley & Sons, Inc., 1979); and *Hollow and Solid Spheres and Microspheres: Science and Technology Associated With Their Fabrication and Application*, Transactions of the Materials Research Society, Volume 372, Edited by David L. Wilcox Sr., et al., (Materials Research Society Press: Greentree, Pa., 1995), both of which are hereby incorporated by reference.

By forming these hollow microspheres in accordance with the present invention, a wide particle size distribution and a wide density distribution can achieved. Such hollow microspheres, especially those in the class of EXPANCEL® microspheres can be expanded, partially or wholly, to about 5 microns to about 50 microns when they are exposed to sufficient temperatures, such as from about 60–80° C. These microspheres may be expanded prior to the drying step or during the drying step of the present invention.

The ingredients from which the low-density particle of the present invention are made include: organic and inorganic builder material, alkalinity source material and other particle ingredient components such as polymers, binding agents and chelants. For greater clarification, these particle ingredients are set-forth below in more detail.

B. Coatings for Low-Density Particles (a) Inorganic and Organic Builder Material Builder material which serves to counteract the effects of calcium, or other ion, water hardness encountered during laundering/bleaching use of the compositions herein can form part of the coating on the low-density coated particles. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate sodium salts of polyacrylic acid, polymaleic acid, and polyacrylic/polymaleic acid copolymers and their salts, such as those sold by BASF under the Sokalan trademark which have molecular weight ranging from about 5,000 to 100,000. These salts may also serve as a desiccant, moisture sink or water scavenger in the non-aqueous liquid detergent compositions herein.

Another suitable type of organic builder comprises the water-soluble salts of higher fatty acids, i.e., "soaps." These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6® is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5®. NaSKS-7® and NaSKS-11®, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z[(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

If utilized as all or part of the suspended particulate solid, insoluble organic detergent builders can generally comprise from about 1% to 20% by weight of the total non-aqueous liquid detergent compositions herein.

(b) Alkalinity Sources

A further material which can form part of the coating on the low-density coated particles is a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant, moisture sink or water scavenger in the non-aqueous liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the suspended particulate solid phase, the alkalinity source will generally comprise from about 1% to 25% by weight of the total non-aqueous liquid detergent compositions herein. Such materials, while water-soluble, will generally be insoluble in the non-aqueous detergent compositions herein.

(c) Other particle ingredient components

The low-density coated particles may also be coated with other particle ingredient components which serve both functionally detersive and structural purposes. One example of a desirable structural ingredient is a water soluble binding agent. Alkylene aminomethylene phosphonic acids or water soluble salts thereof which can serve as an binding agent to hold together the coating materials which encapsulate the outer surface of the microsphere. As is discussed elsewhere in this application, these acids and their corresponding salts can also serve as a chelant which serves to chelate metal ions, e.g., iron and/or manganese, within the detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. A preferred example of the chelant is Diethylene Triamine Penta Methyl Phosphonic Acid (DTMPA) which is available commercially under the name DEQUEST Grade 2066 from the Monsanto Company.

Other suitable binding agents include polymeric compounds such as water soluble maleic/acrylic copolymers (particularly a 40% maleic/60% acrylic blend), water soluble polyacrylates of molecular weights from about 2000 to about 5000 (particularly molecular weights of around 4500).

Also suitable are organic polymers such as polyethylene glycol with a molecular weight of between 1000 and 6000 and polyvinylpyrolidone, particularly crosslinked polyvinylpyrolidone such as those sold under the trade name POLYPLASDONE XL™ or KOLLIDON CL.™

If utilized as all or part of the suspended particulate solid phase, these other components will generally comprise from about 1% to 25% by weight of the total non-aqueous liquid detergent compositions herein. Any of the above described materials can also serve as desiccants, moisture sinks or water scavengers when used in the non-aqueous liquid detergent.

Method Aspect

The present invention also provides a method for preparing the low-density particles of the present invention.

In a first aspect of the methods of the present invention, a method wherein the first step of the process entails continuously mixing and optionally heating an aqueous solution containing the water-soluble binder, as well as one or more particle ingredients in a mixer to form a homogenous solution-slurry is provided. These particle ingredients will form the shell of the low-density particle which is preferably a spherical hollow particle or hollow microsphere. The particle ingredients are added to the aqueous solution in sufficient amounts so that the final low-density particulate product will comprise from about 1% to about 95% of an alkalinity source, from about 1% to about 95% of a builder component and from about 1% to about 95% of binding agents and other low-density particle ingredient components (e.g. chelants and polymers). The aqueous solution will comprise from about 10% to about 70%, preferably from about 20% to about 60%, more preferably from about 30% to about 50% water.

A suitable mixer for this process step is one consisting essentially of a horizontal, hollow static cylinder having a centrally mounted rotating shaft around which several plough-shaped blades are attached. An impeller stirrer is particularly suitable.

The resulting homogenous aqueous solution-slurry is then fed into the heated chamber of a spray-tower where it is dried to from the low-density particles. The low-density particles are dried in such a way that they are completely or partially hollow (i.e. voids or cavities are formed inside). Completely or partially hollow particles can be formed by one of four separate mechanisms:

(a) a droplet of the solution-slurry is first formed and then a surface layer, semi-impervious to vapor flow, forms at the droplet surface. As vapor is formed within the droplet and expands with the increase in droplet temperature a microsphere is formed. Typically, because of their high surface area, spherical spray-dried particles are rapidly converted in the spray-drying process by evaporation of the water solvent into a fine powder.

(b) Moisture evaporates at a rate faster than the diffusion of solids back into the droplet's interior. On completion of evaporation, air voids are present, especially in the case of crystalline products.

(c) Liquid flows with accompanying solids to the droplet surface by capillary action, leaving the center of the droplet as a void.

(d) Air trapped in the solution -slurry contributes to air spaces within the droplet.

One or more spray drying techniques in one or more spray-drying towers may be used to make detergent compositions in accordance with the instant invention and any standard spray drying techniques may be used to execute the processes described herein. Many suitable spray drying techniques and spray drying equipment is discussed in are discussed in K. Masters, *Spray Drying Handbook* $5^{th}$ *Edition*, Longman, New York, which is hereby incorporated by reference. It is preferred that the process be carried out using a rotary-disk atomizer and a co-current flow spray dryer. In the spray-drying process the inlet temperature of the spray-dryer is from about 200° C. to about 700° C. and the outlet temperature is from about 100° C. to about 160° C.

Another drying process useful in accordance with the methods of the present invention is a pulse drying process. Pulse drying comprises introducing a substance to be dried, such as the low-density particles of the present invention, into a heated, flowing, drying medium in the presence of acoustic energy to significantly reduce the moisture content of the substance being processed. Nonlimiting examples of pulse drying processes are described in U.S. Pat. No. 4,226, 668 issued Oct. 7, 1980 to F. A. Ferguson, U.S. Pat. No. 4,859,248 issued Aug. 22, 1989 to Thaler et al., and in "Pulse Combustion Lowers Drying Costs" (Chemical Engineering, Dec. 10, 1984 pp. 44–45), the disclosures of which are incorporated herein by reference. A pulse drying process generally comprises a cyclical pattern of detonations, which preferably occur at about 250 times per second, which provide a high energy, broad-band, accoustic wave front. This sonic energy causes rapid, efficient dispersion of the low-density particles. The sonic waves are thought to "vibrate" each low-density particle, facilitating heat and mass transfer. Although the hot jet gases used to produce the pulses can reach 1371° C. (2500° F.) in temperature, residence time in this turbulent zone is very short, only several milliseconds, so that the actual system temperature of the low-density particles is preferably much lower—about 149° C. (300° F.) maximum. It is the combination of high thermal and sonic energy which disrupts the low-density particles, maximizes surface area, encourages efficient heat transfer, and, thus, provides the physical environment for drying the low-density particles.

In all of the above embodiments, after the expansion and coating ingredient enrobing which the microspheres are subjected, the low-density microspheres have a particle size of from about 1 $\mu$m to about 100 $\mu$m, preferably from about 5 $\mu$m to about 75 $\mu$m. The low-density coated particles of the present invention will have a density of less than about 1.6 g/ml, preferably less than about 1.2 g/ml, more preferably less than about 1.0 g/ml. The density is determined by the use of a helium pynenometer.

The low-density particles and the processes for producing them which are disclosed in the present invention can also be used in the manufacture of granular detergent products, particularly for use as a base granule. The use of the low-density particles in a granular detergent offers several advantages, notably narrow particle size and density distribution and an attractive uniform spherical shape. The narrow particles size distribution is particularly important because it allows more control over the granular detergent morphology and also increases the efficiency, by reducing the recycling and reprocessing of fines (particulates which are too small to be included in a granular detergent) and overs (particulates which are too large to be included in a granular detergent).

When the low-density particles are to be used as a particulate component in the manufacture of a granular detergent composition, then after the low-density particle is formed by the process described above, the particles may be admixed with other detergent particulates to form a granular detergent product. The other detergent components as well as the processes for admixing are all well-known to those skilled in the art. In this case, the low-density particles may be made from a variety of granulate ingredients, the granulate ingredients being selected from the group consisting of surfactants, builders, alkalinity sources, binding agents, bleaching agents, bleach activators, suds suppressors, dye-transfer inhibitors and mixtures thereof. Most preferably the low-density particles are made from surfactants and builders.

B. Adjuvant Particulates

As used in the present invention, "adjuvant particles" refers to all other suspended solid phase particles besides the low-density particles described above. Generally such particulate material will range in size from about 0.1 to 1500 microns, more preferably from about 0.1 to 900 microns. Most preferably, such material will range in size from about 5 to 200 microns.

While the inclusion of these particles allows the formulator to include important detersive component which increase the efficacy of a detergent formulation, these particles also demonstrate a tendency to separate out from the liquid phase and form a layer of sediment on the bottom of a detergent container. The low-density particles have been included in the present invention to counteract this tendency. The adjuvant particulate material utilized herein can comprise one or more types of detergent composition components which in particulate form are substantially insoluble in the non-aqueous liquid phase of the composition. Such materials include peroxygen bleaching agents, bleach activators, organic detergent builders as well as other detergent components. Suitable peroxygen bleaching agents, bleach activators and detergent builders are discussed in greater detail in other parts of this application. These adjuvant particulates are discussed in greater detail under the heading "Solid Particulate Material" in the copending provisional application of Jean-Paul Boutique et al., entitled "Detergent Compositions Comprising Improved Hydrotropes", filed on Aug. 23, 1999 and having P&G Case No. 7694P2.

Surfactant-containing Liquid Phase

The surfactant-containing, non-aqueous liquid phase will generally comprise from about 49% to 99.95% by weight of the detergent compositions herein. More preferably, this liquid phase is surfactant-structured and will comprise from about 52% to 98.9% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc. The liquid phase of the detergent compositions herein is preferably formed from one or more non-aqueous organic diluents into which is mixed a surfactant structuring agent which is preferably a specific type of anionic surfactant-containing powder.

(a) Non-aqueous Organic Diluents

The major component of the liquid phase of the detergent compositions herein comprises one or more non-aqueous organic diluents. The non-aqueous organic diluents used in this invention may be either surface active, i.e., surfactant, liquids or non-aqueous, non-surfactant liquids referred to herein as non-aqueous solvents. The term "solvent" is used herein to connote the non-surfactant, non-aqueous liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The non-aqueous liquid diluent component will generally comprise from about 50% to 100%, more preferably from about 50% to 80%, most preferably from about 55% to 75%, of a structured, surfactant-containing liquid phase. Preferably the liquid phase of the compositions herein, i.e., the non-aqueous liquid diluent component, will comprise both non-aqueous liquid surfactants and non-surfactant non-aqueous solvents.

i) Non-aqueous Surfactant Liquids

Suitable types of non-aqueous surfactant liquids which can be used to form the liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Additional examples of liquid surfactants suitable for use in the present invention may be found in the copending provisional application of Jean-Paul Boutique et al., entitled "Detergent Compositions Comprising Improved Hydrotropes", filed on Aug. 23, 1999 and having P&G Case No. 7694P2.

The amount of total liquid surfactant in the preferred surfactant-structured, non-aqueous liquid phase herein will be determined by the type and amounts of other composition components and by the desired composition properties. Generally, the liquid surfactant can comprise from about 35% to 70% of the non-aqueous liquid phase of the compositions herein. More preferably, the liquid surfactant will comprise from about 50% to 65% of a non-aqueous structured liquid phase. This corresponds to a non-aqueous liquid surfactant concentration in the total composition of from about 15% to 70% by weight, more preferably from about 20% to 50% by weight, of the composition.

Also suitable for use in the present invention are low foaming surfactants, such as conventional secondary alkyl sulfate surfactants which are those materials which have the sulfate moiety distributed randomly along the hydrocarbyl "backbone" of the molecule as well as mid-chain branched surfactants which are mid-chain branched primary alkyl sulfate surfactants and mid-chain branched primary alkyl alkoxoxylated sulfate surfactants having an average of greater than 14.5 carbon atoms. The mid-chain branched surfactants are discussed in greater detail in the copending application of Malcolm Dodd et al., entitled "Processes for Making a Granular Detergent Composition Containing Mid-Chain Branched Surfactants," having P&G Case No. 6869P, serial no. 60/061,876, filed on Oct. 10, 1997, hereby incorporated by reference. Nonionic surfactants also generally low foaming surfactants.

ii) Non-surfactant Non-aqueous Organic Solvents

The liquid phase of the detergent compositions herein may also comprise one or more non-surfactant, non-aqueous organic solvents. Such non-surfactant non-aqueous liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the non-aqueous liquid detergent compositions herein do include non-vicinal $C_4$–$C_8$ alkylene glycols, alkylene glycol mono lower alkyl ethers, lower molecular weight polyethylene glycols, lower molecular weight methyl esters and amides, and the like.

A preferred type of non-aqueous, low-polarity solvent for use in the compositions herein comprises the non-vicinal $C_4$–$C_8$ branched or straight chain alkylene glycols. Materials of this type include hexylene glycol (4-methyl-2,4-pentanediol), 1,6-hexanediol, 1,3-butylene glycol and 1,4-butylene glycol. Hexylene glycol is the most preferred.

Another preferred type of non-aqueous, low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve. Another preferred type of non-aqueous, low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar, non-aqueous solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The non-aqueous, generally low-polarity, non-surfactant organic solvent(s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a non-aqueous, low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents

In systems which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the Theological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

(b) Surfactant Structurant

The non-aqueous liquid phase of the detergent compositions of this invention is prepared by combining with the non-aqueous organic liquid diluents hereinbefore described a surfactant which is generally, but not necessarily, selected to add structure to the non-aqueous liquid phase of the detergent compositions herein. Structuring surfactants can be of the anionic, nonionic, cationic, and/or amphoteric types. Structuring surfactants are discussed in greater detail in the copending provisional application of Jean-Paul Boutique et al., entitled "Detergent Compositions Comprising Improved Hydrotropes", filed on Aug. 23, 1999 and having P&G Case No. 7694P2, incorporated above and in the copending application of Jay I. Kahn et al., entitled "Preparation of Nonaqueous, Particulate-Containing Liquid Detergent Compositions with Surfactant-Structured Liquid Phase", having P&G Case No. 6150, Ser. No. 09/202,964, filed on Dec. 23, 1998, which is hereby incorporated by reference.

Other Optional Composition Components

In addition to the composition liquid and solid phase components as hereinbefore described, the detergent compositions herein can, and preferably will, contain various other optional components. Some of the following optional components will be found in the present compositions in the suspended solid phase, while others will be in the surfactant-rich liquid phase. The optional components may either dissolve in the liquid phase or may be dispersed within the liquid phase in the form of fine particles or droplets. Some of the other materials which may optionally be utilized in the compositions herein are described in greater detail as follows:

(a) Optional Inorganic Detergent Builders

The detergent compositions herein may also optionally contain one or more types of inorganic detergent builders beyond those listed above that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(b) Optional Enzymes

Enzymes can be included in the formulations herein for a wide variety of fabric laundering purposes, including removal of protein-based, carbohydrate-based, or triglyceride-based stains; for the prevention of refugee dye transfer; and for fabric restoration. It is believed that the addition of the special hydrotropes described above will enhance the performance of enzymes in a detergent composition. This is because as the hydrotropes increase the rate of dissolution of the detergent composition, the rate at which enzymes come into contact with water and are activated will also increase and the corresponding detersive benefits provided by activated enzymes will also increase. This behavior is seen in both aqueous and non-aqueous detergent compositions.

The enzymes to be incorporated include proteases, amylases, lipases, mannanase, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *Bacillus subtilis* and *Bacillus licheniforms*. Another suitable protease is obtained from a strain of Bacillus, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo Industries A/S. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, amylases described in British Patent Specification No. 1,296,839 (Novo Industries A/S), RAPIDASE®, International Bio-Synthetics, Inc. and TERMAMYL®, Novo Industries A/S.

Mannanases include the following three mannans-degrading enzymes: EC 3.2.1.25: β-mannosidase, EC 3.2.1.78: Endo-1,4-β-mannosidase, referred therein after as "mannanase" and EC 3.2.1.100: 1,4-β-mannobiosidase (IUPAC Classification-Enzyme nomenclature, 1992 ISBN 0-12-227165-3 Academic Press).

Further examples of enzymes suitable for use in the present invention can be found in the copending provisional application of Jean-Paul Boutique et al., entitled "Detergent Compositions Comprising Improved Hydrotropes", filed on Aug. 23, 1999 and having P&G Case No. 7694P2, incorporated above.

(c) Optional Chelating Agents

The non-aqueous liquid phase of the present invention may also optionally contain a chelating agent which serves to chelate metal ions, e.g., iron and/or manganese, within the detergent compositions herein. Suitable chelating agents are those described above under the heading entitled "Low-Density Particles." The chelating agent, if employed, can comprise from about 0.1% to 4% by weight of the compositions herein. More preferably, the chelating agent will comprise from about 0.2% to 2% by weight of the detergent compositions herein.

(d) Suds Suppressors

Suds suppression can be of particular importance in the present invention because of the high concentration of the detergent composition. The use of suds suppressors in "high concentration cleaning process" is described in greater detail U.S. Pat. No. 4,489,455 and 4,489,574.

Suitable suds suppressors are discussed in greater detail in the copending provisional application of Jean-Paul Boutique et al., entitled "Detergent Compositions Comprising Improved Hydrotropes", filed on Aug. 23, 1999 and having P&G Case No. 7694P2, incorporated above.

(e) Dye Transfer Inhibiting Agents and Other Fabric Care Components

The compositions of the present invention may also include one or more materials effective for inhibiting the transfer of dyes from one fabric to another during the cleaning process. These agents may be included either in the nonaqueous surfactant-containing liquid phase or in the solid particulate material. Such materials are discussed in greater detail in the copending provisional application of Jean-Paul Boutique et al., entitled "Detergent Compositions Comprising Improved Hydrotropes", filed on Aug. 23, 1999 and having P&G Case No. 7694P2, incorporated above.

Thus the present invention may also include materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. Such fabric appearance benefits can include, for example, improved overall appearance of the laundered fabrics, reduction of the formation of pills and fuzz, protection against color fading, improved abrasion resistance, etc.

One such fabric care agent which specifically acts to prevent dyes from migrating from the surface of a garment and into the aqueous laundering solution but also provides other fabric care benefits is 30 polyethyleneimine, PEI 600 E20, having the general formula:

$$[E_2NCH_2CH_2]_w[\overset{\overset{E}{|}}{N}CH_2CH_2]_x[\overset{\overset{B}{|}}{N}CH_2CH_2)_yNE_2$$

wherein B is a continuation by branching of the polyethyleneimine backbone. E is an ethyleneoxy unit having the formula:

$$—(CH_2CH_2O)mH$$

wherein m has an average value of about 20. What is meant herein by an average value of 20 is that sufficient ethylene oxide or other suitable reagent is reacted with the polyethyleneimine starting material to fully ethoxylate each N-H unit to a degree of 20 ethoxylations. However, those skilled in the art will realize that some N-H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$$H_2N—CH_2CH_2]— \text{ and } —NH_2$$

which terminate the main backbone and any branching chains, secondary amine units having the formula:

$$——[\overset{\overset{H}{|}}{N}—CH_2CH_2]——$$

and which, after modification, have their hydrogen atom substituted by an average of 20 ethyleneoxy units, and tertiary amine units having the formula:

$$——[\overset{\overset{B}{|}}{N}—CH_2CH_2]——$$

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present. The average molecular weight for each ethylene backbone unit, $—NCH_2CH_2—$, is approximately 43 daltons.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8,1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Other suitable fabric care agents for use in the present detergent compositions include dye maintenance polymers. One example of such a polymer is the Adduct of Imidazole-epichlorohydrin:

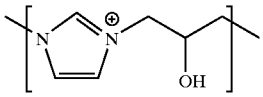

(Idealized Structure)

This has a ratio of imidazole:epichlorohydrin of 1.36:1. Further dye maintenance polymers as well as the Dye Maintenance Parameter Test are described in the copending provisional application of Rajan K. Panandiker et al., entitled "Laundry Detergent Compositions with a Cationically Charged Dye Maintenance Polymer," having P&G Case No. 7488P and serial no. 60/126,074, filed on march 25, 1999, which is hereby incorporated by reference. As described above, these dye maintenance polymers provide overall fabric care benefits in addition to color care protection.

(f) Optional Thickening. Viscosity Control and/or Dispersing Agents

The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

Other suitable polymeric materials suitable for use as thickening, viscosity control and/or dispersing agents include polymers of: castor oil derivatives; polyurethane derivatives, and polyethylene glycol.

If utilized, the optional thickening, viscosity control and/or dispersing agents should be present in the compositions herein to the extent of from about 0.1% to 4% by weight. More preferably, such materials can comprise from about 0.1% to 2% by weight of the detergents compositions herein.

(g) Optional Clay Soil Removal/Anti-redeposition Agents

The compositions of the present invention can also optionally contain water-soluble ethoxylated amines having clay soil removal and anti-redeposition properties. If used, soil materials can contain from about 0.01% to about 5% by weight of the compositions herein. Clay Soil Removal and Anti-redeposition Agents are discussed in greater detail in the copending provisional application of the copending provisional application of Jean-Paul Boutique et al., entitled "Detergent Compositions Comprising Improved Hydrotropes", filed on Aug. 23, 1999 and having P&G Case No. 7694P2, incorporated above.

Other clay soil removal and/or anti-redeposition agents known in the art can also be utilized in the compositions herein. Another type of preferred anti-redeposition agent includes the carboxy methyl cellulose (CMC) materials. These materials are well known in the art.

(h) Optional Liquid Bleach Activators

The detergent compositions herein may also optionally contain bleach activators which are liquid in form at room temperature and which can be added as liquids to the liquid phase of the detergent compositions herein. One such liquid bleach activator is glycerol triacetate, which serves as a solvent in the composition during storage but when released into the wash water solution is peroxidized and functions as a bleach activator. Other examples of bleach activators include acetyl triethyl citrate (ATC) and nonanoyl valerolactam. Liquid bleach activators can be dissolved in the liquid phase of the compositions herein.

(i) Optional Brighteners. Dyes and/or Perfumes

The detergent compositions herein may also optionally contain conventional brighteners, bleach catalysts, dyes and/or perfume materials. Such brighteners, silicone oils, bleach catalysts, dyes and perfumes must, of course, be compatible and non-reactive with the other composition components in the aqueous or non-aqueous liquid environment. If present, brighteners, dyes and/or perfumes will typically comprise from about 0.0001% to 2% by weight of the compositions herein.

(j) Structure Elasticizing Agents

The liquid detergent compositions herein can also contain from about 0.1% to 5%, preferably from about 0.1% to 2% by weight of a finely divided, solid particulate material which can include silica, e.g., fumed silica, titanium dioxide, insoluble carbonates, finely divided carbon, SD-3 bentone, clays, or combinations of these materials. Clays are well known to those skilled in the art and are commercially available from companies such as Rheox. Fine particulate material of this type functions as a structure elasticizing agent in the products of this invention. Such material has an average particle size ranging from about 7 to 40 nanometers, more preferably from about 7 to 15 nanometers. Such material also has a specific surface area which ranges from about 40 to 400 $m^2/g$.

The finely divided elasticizing agent material can improve the shipping stability of the liquid detergent products herein by increasing the elasticity of the surfactant-structured liquid phase without increasing product viscosity. This permits such products to withstand high frequency vibration which may be encountered during shipping without undergoing undesirable structure breakdown which could lead to sedimentation in the product.

In the case of titanium dioxide, the use of this material also imparts whiteness to the suspension of particulate material within the detergent compositions herein. This effect improves the overall appearance of the product.

(k) Microspheres

Microspheres may be used in the present invention. Suitable microspheres may be made of one or more water-insoluble materials selected from the group consisting of: polymers; silicaceous materials; ceramics and mixtures thereof. For further discussion of microspheres, see "Microencapsulation" in Kirk-Othmer Encyclopedia of Chemical Technology, Third Edition, Volume 16, pages 628–651 (John Wiley & Sons, Inc., 1979), which is hereby incorporated by reference.

Commercially available microspheres are available from Akzo-Nobel of Sweden under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEX®.

Microspheres are discussed in greater detail in the copending provisional application of Jean-Paul Boutique et al., entitled "Detergent Compositions Comprising Improved Hydrotropes", filed on Aug. 23, 1999 and having P&G Case No. 7694P2, incorporated above. Methods for coating microspheres are discussed in the copending provisional application of Yousef Aouad et al., entitled "Nonaqueous Liquid Detergent with Wash-water soluble Low-Density Filler Particles", having P&G Case No. 7708P, and filed on Aug. 10, 1999, which is hereby incorporated by reference. Biomaterial microspheres are also discussed in the copending provisional application of Eugene S. Sadlowski et al, entitled "Nonaqueous Liquid Detergent With Wash-Water Soluble Low-Density Filler Particles", having P&G Case No. 7707P, filed on Aug. 10, 1999, which is hereby incorporated by reference.

Composition Form

As indicated, the aqueous and non-aqueous liquid detergent compositions herein are in the form of bleaching agent and/or other materials in particulate form as a solid phase suspended in and dispersed throughout a surfactant-containing, preferably structured, preferably non-aqueous liquid phase. Generally, the structured non-aqueous liquid phase will comprise from about 49% to 99.95%, more preferably from about 52% to 98.5%, by weight of the composition with the dispersed additional solid materials comprising from about 1% to 50%, more preferably from about 29% to 44%, by weight of the composition.

The particulate-containing liquid detergent compositions of this invention are substantially non-aqueous (or anhydrous) in character. While very small amounts of water may be incorporated into such compositions as an impurity in the essential or optional components, the amount of free water should in no event exceed about 1% by weight of the compositions herein. More preferably, water content of the non-aqueous detergent compositions herein will comprise less than about 1% by weight.

The particulate-containing non-aqueous liquid detergent compositions herein will be relatively viscous and phase stable under conditions of commercial marketing and use of such compositions. Frequently the viscosity of the compositions herein will range from about 300 to 8,000 cps, more preferably from about 1000 to 4,000 cps. For purposes of this invention, viscosity is measured with a Carrimed CSL2 Rheometer at a shear rate of 20 $s^{-1}$.

Composition Preparation and Use

The preparation of non-aqueous liquid detergent compositions is discussed in detail in Copending application of Jay 1. Kahn et al., entitled "Preparation of Nonaqueous, Particulate-Containing Liquid Detergent Compositions with Surfactant-Structured Liquid Phase", having P&G Case No. 6150, Ser. No. 09/202,964, filed on Dec. 23, 1998, which is hereby incorporated by reference.

An effective amount of the liquid detergent compositions herein added to water to form aqueous laundering/bleaching solutions can comprise amounts sufficient to form from about 500 to 10,000 ppm of composition in aqueous solution. More preferably, from about 800 to 8,000 ppm of the detergent compositions herein will be provided in aqueous washing/bleaching solution.

In order to make the present invention more readily understood, reference is made to the following example, which is intended to be illustrative only and not intended to be limiting in scope.

Detergent compositions made in accordance with the invention are described and exemplified below.

EXAMPLE I

A 40% solution of sodium carbonate, sodium citrate and diethylene triamine penta methyl phosphonic acid present in the ratio of 10/3/3 was prepared. This solution was then passed through a spray tower equipped with a rotary atomizer operating at 15,000 RPM. The spray-tower is operating with co-current stream of hot air, an inlet temperature of approximately 205° C. to 220° C. and an outlet temperature of approximately 95° C. to 105° C. Passing the solution through the spray tower results in the formation of a low-density coated particle. The total product had an average density of 1.0822 g/ml with a standard deviation of 0.0261 g/ml; an average bulk density of 536 g/l with a standard deviation of 18 g/l; and a average moisture content of 1.3% with a standard deviation of 0.4%.

EXAMPLE II

A 40% solution of sodium carbonate, sodium citrate and diethylene triamine penta methyl phosphonic acid present in the ratio of 10/3/3 was prepared. This solution was then passed through a spray tower equipped with a pulse drying chamber (drum). The pulses of hot gases entering the drying chamber are at a temperature of about 1000° C. Passing the solution through the spray tower results in the formation of a low-density coated particle. The total product had an average density of 1.0822 g/ml with a standard deviation of 0.0261 g/ml; an average bulk density of 536 g/l with a standard deviation of 18 g/l; and a average moisture content of 1.3% with a standard deviation of 0.4%.

The low-density coated particles formed in Example 1 and/or n can then be added as a component in the following non-aqueous liquid detergent composition prepared in accordance with the present invention and which has the following overall composition:

| Component | Wt % |
|---|---|
| Na LAS | 15.33 |
| Nonionic Surfactant[1] | 20.4 |
| n-BPP | 17.55 |
| Hydrotrope[2] | 4.74 |
| NaCitrate dihydrate | 3.66 |
| Phosphonate[3] | 2.85 |
| $Na_3$EDDS | 1.15 |
| Ethoxylated Quaternized amine clay material | 1.23 |
| Na Perborate | 11.38 |
| Bleach Activator | 5.69 |
| NaCarbonate | 9.49 |
| Protease | 0.81 |
| Amylase | 0.76 |
| Carezyme | 0.03 |
| Q-Cell 300 microspheres | 0.95 |
| Silicone premix | 1.02 |
| fatty acid[4] | 0.47 |
| $TiO_2$ | 0.47 |
| brightener | 0.19 |
| PEG 8000 | 0.38 |
| Sulfate | 0.43 |
| $H_2O$ | 0.20 |
| Miscellaneous up to 100% | 0.82 |
| TOTAL | 100% |

[1]Neodol 23-5
[2]1,4-Cyclo Hexane Di Methanol
[3]diethylenetriaminepenta (methylenephosphonic acid)
[4]sodium salt of hydrogenated C18-18 fatty acid

What is claimed is:

1. A non-aqueous liquid detergent comprising:

a) from about 49% to about 99.95% by weight of the composition of a surfactant-containing non-aqueous liquid phase; and b) from about 0.05% to about 51% by weight of the composition of a suspended solid particulate phase wherein the suspended solid particulate phase is characterized by completely or partially hollow low-density particles which are composed of a binding agent and materials selected from the group consisting of an alkalinity source, a chelant, a builder, polymers and mixtures thereof, wherein the low-density particles are substantially insoluble in said liquid phase and substantially soluble in pure water.

2. A non-aqueous liquid detergent composition according to claim 1 wherein the low-density particles have a particle size of from about 1 $\mu$m to about 100 $\mu$m.

3. A non-aqueous liquid detergent composition according to claim 1 wherein the low-density particles have an average density of less than 1.6 g/ml.

4. A non-aqueous liquid detergent composition according to claim 1 wherein the low-density particles are in the form of microspheres.

5. A non-aqueous liquid detergent composition according to claim 1 where the composition comprises from 1% to 20% of builders, from 1% to 25% of an alkalinity source and from 1% to 25% of binding agents and a component selected from the group consisting of chelants, polymers and mixtures thereof.

6. A non-aqueous liquid detergent composition according to claim 1 wherein the low-density particle comprises:

(a) from 1% to 95% of binding agents and a component selected from the group consisting of chelants, polymers and mixtures thereof;

(b) from 1% to 95% of an alkalinity source; and (c) from 1% to 95% of a builder component.

7. A non-aqueous liquid detergent composition according to claim 1 wherein the low-density particle is prepared by:

a) forming an aqueous solution of binding agents, an alkalinity source, a builder and a further component selected from the group consisting of chelants, polymers and mixtures thereof; and b) subsequently drying the aqueous solution in a spray-dryer, wherein the inlet temperature is from 200° C. to 700° C. and the outlet temperature is from 100° C. to 160° C.

8. A non-aqueous liquid detergent composition according to claim 1 wherein the suspended solid particulate phase further comprises adjuvant particulates, having a particle size of from 0.1 to 1500 microns which are substantially insoluble in said liquid phase and which are selected from peroxygen bleaching agents, bleach activators, organic detergent builders, inorganic alkalinity sources and combinations thereof, whereby the downward flow of the insoluble particulates in said composition is impeded by the presence of the low-density particles and wherein the adjuvant is an aluminosilicate detergent builder and a poly(4-vinylpyridine-N-oxide) having an average molecular weight of 50,000 and an amine to amine N-oxide ratio of 1:4.

9. A process for continuously preparing low-density particles according to claim 1 comprising the steps of:

(a) continuously mixing water, water-soluble binder and one or more particle ingredients to form an aqueous solution; and (b) drying the solution in a spray-dryer to form a low-density particle having a substantially spherical shape and a particle size from 1 $\mu$m to 100 $\mu$m.

10. A process according to claim 9 wherein the inlet temperature of the spray-dryer in step (b) is from 200° C. to 700° C. and the outlet temperature is from 100° C. to 160° C.

11. A process according to claim 9 wherein the aqueous solution comprises from about 10% to 70% water.

12. A process according to claim 9 wherein the low-density particles have an average density of less than 1.6 g/ml.

13. A process according to claim 9 wherein the low-density coated particles have a particle size of from 1 $\mu$m to 100 $\mu$m.

14. A process according to claim 9 wherein the process further is characterized by the step of admixing the low-density particles with other detergent particles to form a granular detergent composition.

15. A process according to claim 9 wherein the drying step occurs via a pulse drying process.

* * * * *